US008672090B1

(12) United States Patent
Abram

(10) Patent No.: US 8,672,090 B1
(45) Date of Patent: Mar. 18, 2014

(54) EXHAUST COMPONENT WITH VIBRATION ISOLATED PIPE

(71) Applicant: Faurecia Emissions Control Technologies, Columbus, IN (US)

(72) Inventor: Kwin Abram, Columbus, IN (US)

(73) Assignee: Favrecia Emissions Control Technologies, Columbus, IN (US)

( * ) Notice: Subject to any disclaimer, the term of this patent is extended or adjusted under 35 U.S.C. 154(b) by 0 days.

(21) Appl. No.: 13/632,009

(22) Filed: Sep. 30, 2012

(51) Int. Cl.
*F01N 13/08* (2010.01)

(52) U.S. Cl.
USPC ..... 181/228; 181/212; 181/227; 181/282

(58) Field of Classification Search
USPC ..... 181/228, 227, 212, 282
See application file for complete search history.

(56) References Cited

U.S. PATENT DOCUMENTS

| | | | | |
|---|---|---|---|---|
| 3,947,252 | A | 3/1976 | Musall et al. | |
| 4,315,558 | A * | 2/1982 | Katayama | 181/227 |
| 4,349,078 | A | 9/1982 | Shimada et al. | |
| 5,984,372 | A * | 11/1999 | Cwik et al. | 285/49 |
| 6,058,702 | A * | 5/2000 | Jorg Alexnat et al. | 60/322 |
| 6,086,110 | A * | 7/2000 | Lee et al. | 285/49 |
| 6,167,622 | B1 * | 1/2001 | Cwik | 29/890.144 |
| 6,173,800 | B1 | 1/2001 | Steenackers et al. | |
| 6,240,969 | B1 * | 6/2001 | Wildermuth | 138/122 |
| 6,260,652 | B1 | 7/2001 | Steenackers et al. | |
| 6,298,935 | B1 | 10/2001 | Steenackers et al. | |
| 6,354,632 | B1 * | 3/2002 | Jung et al. | 285/49 |
| 6,536,548 | B2 | 3/2003 | Steenackers et al. | |
| 7,458,440 | B2 * | 12/2008 | Uegane | 181/228 |
| 7,810,610 | B2 * | 10/2010 | Nishimura et al. | 181/251 |
| 2012/0273300 | A1 * | 11/2012 | Jones et al. | 181/228 |

FOREIGN PATENT DOCUMENTS

| | | | |
|---|---|---|---|
| DE | 202004000635 | U1 | 5/2004 |
| EP | 0807749 | B1 | 5/1997 |
| EP | 0875410 | B1 | 4/1998 |
| EP | 0925984 | B1 | 11/1998 |
| EP | 1582713 | A1 | 10/2005 |
| FR | 2905726 | A1 | 9/2006 |

* cited by examiner

*Primary Examiner* — Forrest M Phillips
(74) *Attorney, Agent, or Firm* — Carlson, Gaskey & Olds

(57) ABSTRACT

A vehicle exhaust system includes an exhaust component having an inlet and an outlet. The exhaust component is configured to be fixed to a vehicle body. A pipe extends through the exhaust component from the inlet to the outlet. The pipe is mounted for movement relative to the exhaust component at the inlet and the outlet.

23 Claims, 1 Drawing Sheet

EXHAUST COMPONENT WITH VIBRATION ISOLATED PIPE

TECHNICAL FIELD

The subject invention relates to a vehicle exhaust system that includes a vibration isolated thru-pipe connection within an exhaust component.

BACKGROUND OF THE INVENTION

An exhaust system conducts hot exhaust gases generated by an engine through various exhaust components to reduce emissions and control noise. The exhaust system includes one or more mufflers which work in conjunction with pipes/tubes to attenuate noise. In one known mounting configuration, a muffler includes an outer housing that is fixed to a vehicle underbody structure. Due to the high exhaust gas temperatures generated by the exhaust system, the muffler and other exhaust system components are subjected to a significant amount of thermal expansion. Thermal expansion can introduce high levels of stress at connection interfaces between exhaust components, such as connection interfaces between the muffler and associated muffler components, which can lead to premature wear and potential failure.

In addition to experiencing thermal expansion, mufflers are also subjected to high levels of vibration. Mufflers that are mounted directly to vehicle underbodies can receive and transmit high levels of vibration to the vehicle. These vibrations are initiated by engine vibrations transmitted through the exhaust components, and are also initiated by acoustic waves within the exhaust system which excite the exhaust components.

SUMMARY OF THE INVENTION

In one exemplary embodiment, a vehicle exhaust system includes an exhaust component having an inlet and an outlet. The exhaust component is configured to be fixed to a vehicle body. A pipe extends through the exhaust component from the inlet to the outlet. The pipe is mounted for movement relative to the exhaust component at the inlet and the outlet.

In a further embodiment of the above, the pipe comprises a single-piece pipe.

In a further embodiment of any of the above, the pipe includes a plurality of perforations.

In a further embodiment of any of the above, the system includes at least one rigid attachment interface between the exhaust component and the vehicle body, and includes a floating attachment interface between the pipe and the exhaust component.

In a further embodiment of any of the above, the floating attachment interface comprises a first bellows connecting the pipe to an inlet end of the exhaust component and a second bellows connecting the pipe to an outlet end of the exhaust component.

In a further embodiment of any of the above, the exhaust component comprises a muffler.

In a further embodiment of any of the above, the muffler includes an outer muffler housing defining an internal cavity, the outer muffler housing having an exhaust gas inlet and an exhaust gas outlet. A first connection interface is configured to attach the outer muffler housing to a vehicle body. A pipe extends through the internal cavity of the outer muffler housing from the inlet to the outlet. A second connection interface is configured to attach the pipe to the outer muffler housing such that the pipe is isolated from the muffler at the exhaust gas inlet and the outlet.

In one example embodiment, a method of operating a vehicle exhaust component comprises the steps of providing an exhaust component having an inlet and an outlet, rigidly fixing the exhaust component to a vehicle body, extending a pipe through an internal cavity of the exhaust component from the inlet to the outlet, and isolating the pipe from direct connection to the exhaust component at the inlet and outlet such that the pipe is moveable relative to the exhaust component at the inlet and the outlet.

These and other features of this application will be best understood from the following specification and drawings, the following of which is a brief description.

DETAILED DESCRIPTION

Figure 1:
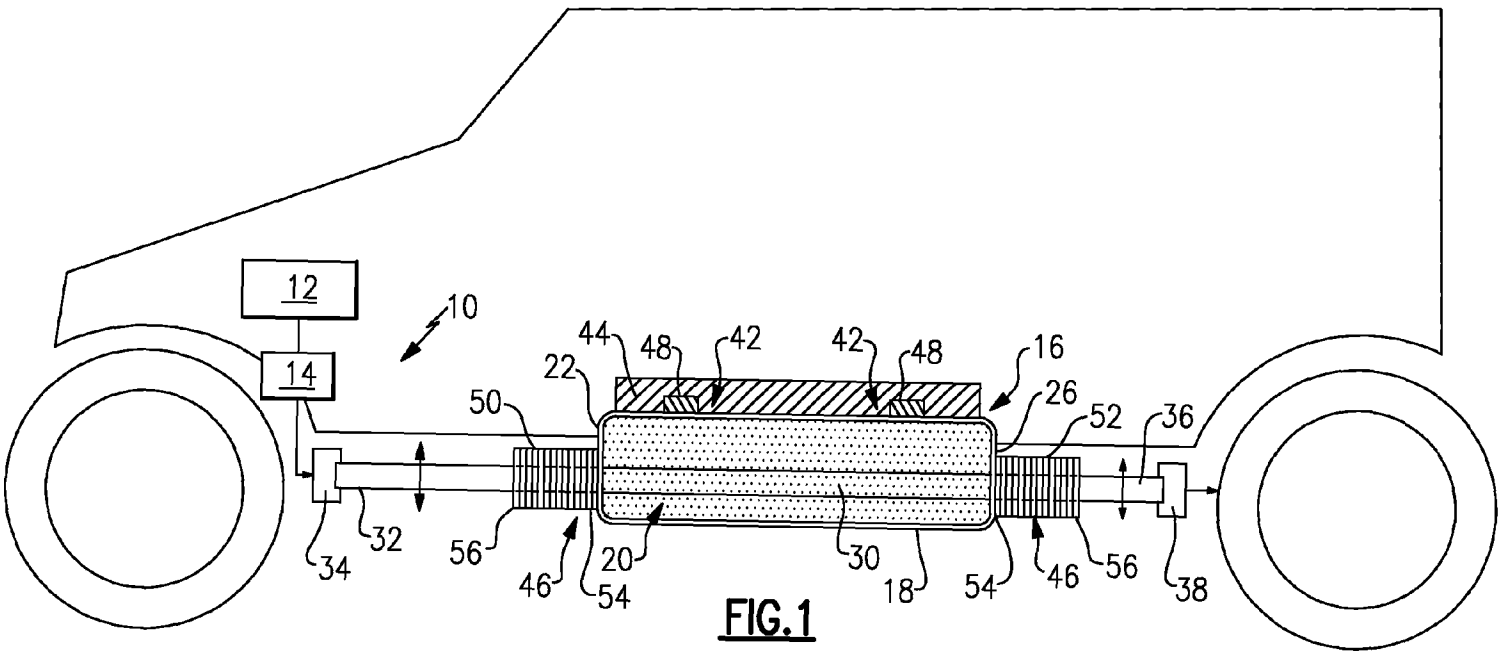
FIG. 1 schematically illustrates one example of an exhaust system with a muffler mounted according to the subject invention.

FIG. 1 shows a vehicle exhaust system 10 that conducts hot exhaust gases generated by an engine 12 through various exhaust components 14 to reduce emission and control noise as known. The various exhaust components 14 can include diesel oxidation catalysts (DOC), selective catalytic reduction (SCR) catalysts, particulate filters, exhaust pipes, etc. These components 14 can be mounted in various different configurations and combinations dependent upon vehicle application and available packaging space.

Figure 2:
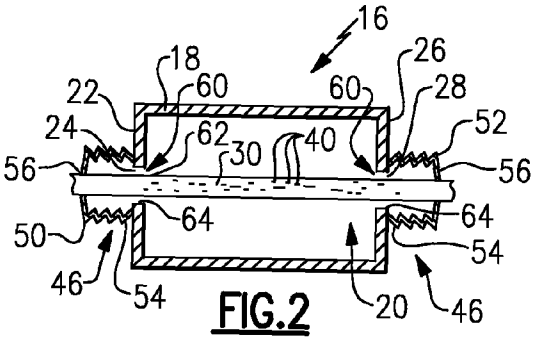
FIG. 2 is a cross-sectional view of a pipe mounting configuration from FIG. 1.

The exhaust system 10 also includes at least one muffler 16 that functions to attenuate exhaust noise. The muffler 16 includes an outer housing 18 that defines an internal cavity 20. As best shown in FIG. 2, the muffler housing 18 has an inlet end 22 with an exhaust gas inlet opening 24 and an outlet end 26 with an exhaust gas outlet opening 28.

A pipe 30, comprising a single-piece thru-pipe, extends through the internal cavity 20 from the inlet end 22 to the outlet end 26. As shown in FIG. 1, the pipe 30 has a first pipe end 32 that extends through the inlet opening 24 and upstream from the inlet end 22 to connect to an upstream pipe or exhaust component 34. The pipe 30 has a second pipe end 36 that extends through the outlet opening 28 and downstream from the outlet end 26 to connect to a downstream component or tailpipe 38. Thus, the pipe 30 comprises a single-piece component that extends from a location upstream of the muffler 16 and then entirely through the internal cavity 20 of the muffler 16 to a location downstream of the muffler 16.

In one example, the pipe 30 includes a plurality of perforations 40 to allow exhaust gas to flow from inside the pipe 30 into the internal cavity 20 of the muffler 16. The internal cavity 20 of the muffler 16 can comprise an empty space, or can be fully or partially packed with sound absorbing material.

A first connection interface 42 attaches the muffler housing 18 to a vehicle body structure 44. A second connection interface 46 attaches the pipe 30 to the muffler housing 18 such that the pipe 30 is vibration isolated from the muffler 16 at the exhaust gas inlet opening 24 and the outlet opening 28. The first connection interface 42 comprises a rigid, i.e. fixed, connection interface to the vehicle body structure 44 and the second connection interface 46 comprises a "floating" or moveable connection interface that allows the pipe 30 to float within the rigidly mounted muffler 16.

In one example, the first connection interface 42 comprises a rigid connection through one or more fasteners 48. In another example, the first connection interface can be a welded interface. In another example, the muffler 16 could comprise an open top with the vehicle body structure 44 serving to close the internal cavity 20 once the housing 18 is fixed to the vehicle body structure 44.

As discussed above, the second connection interface 46 comprises a floating connection such that the pipe 30 is decoupled from the housing 18 and is moveable relative to the muffler 16 at the exhaust gas inlet opening 24 and outlet opening 28. In one example, the second connection interface 46 comprises a first bellows 50 that connects the pipe 30 to an inlet end 22 of the muffler housing 18 and a second bellows 52 that connects the pipe 30 to an outlet end 26 of the muffler housing 18. The bellows 50, 52 are configured from a resilient, flexible material that accommodates the thermal expansion that is exhibited by the muffler 16 and pipe 30 during vehicle operation. As such, the pipe 30 is not directly mounted to any portion of the housing 18.

It should be understood that the second connection interface 46 can comprise any of various structures that provide a floating or movable connection between the housing and pipe. Bellows are one example of such a structure. Other structures such as slip-joints, rubber joints, etc. could also be used.

Each bellows 50, 52 has a first end 54 that is attached to the muffler housing 18 and a second end 56 that is attached to the pipe 30. In one example, the first ends 54 are mounted to surround the inlet 24 and outlet 28 openings. The first ends 54 can be connected to the housing 18 through any of various connection interfaces, such as welding, brazing, clamping, fastening, etc. The second end 56 of the first bellows 50 is connected to the pipe 30 at a location upstream of the muffler 16 but downstream of the first pipe end 32. The second end 56 of the second bellows 52 is connected to the pipe 30 at a location downstream of the muffler 16 and upstream of the second pipe end 36. The second ends 56 can be connected to the pipe 30 through any of various connection interfaces, such as clamping, fastening, etc.

The bellows 50, 52 allow the pipe 30 to float within the openings 24, 28 such that a gap 60 is formed between the outer surface 62 of the pipe 30 and a housing surface 64 that defines the openings 24, 28. This floating connection prevents vibrations in the muffler 16 from being directly communicated to the pipe 30, which results in a significant stress reduction.

Figure 3:
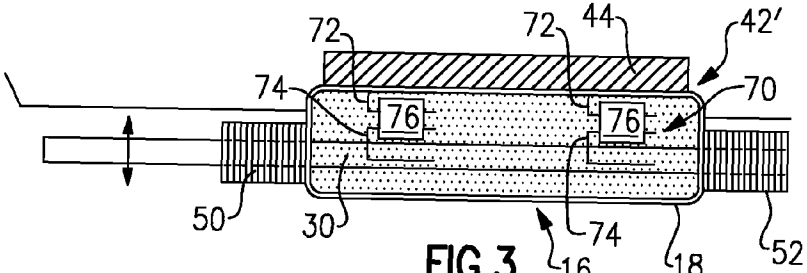
FIG. 3 schematically illustrates another example

In another example embodiment shown in FIG. 3, in addition to the first and second bellows 50, 52, the pipe 30 includes an additional mounting interface 70 within the muffler 16. In this example, the first connection interface 42' includes at least one muffler hanger 72 at least partially positioned within the internal cavity 20 to rigidly fix the muffler housing 18 to the vehicle body structure 44.

At least one pipe hanger 74 is also positioned within the internal cavity 20 to provide additional support for the pipe 30 within the outer housing 18. The pipe hanger 74 can be attached or coupled to the pipe 30 in any of various ways including welding, brazing, fastening, clamping, or welding for example. The muffler hanger 72 and the pipe hanger 74 are connected to each other with a resilient block 76 to further isolate the pipe 30 from muffler vibrations and allow the pipe 30 to move freely within the muffler 16. The resilient block 76 can be made from any type of resilient material that can be subjected to high exhaust gas temperatures, such as silicon rubber, for example.

In one example, a pair of muffler hangers 72 and associated pipe hangers 74 is used. Additional hangers could also be used as needed.

The mounting configuration of FIG. 3 offers additional installation advantages. As the hangers 72, 74 would be installed in the muffler prior to installation of the muffler within the vehicle, the OEM would simply have to rigid mount the muffler assembly to the vehicle body structure and the pipe would be automatically isolated. Further, the configuration of the hangers could be common to various muffler configurations, which would reduce costs.

One example method of operating a vehicle exhaust component include providing an exhaust component, such as the muffler 16 for example, with an inlet and an outlet, rigidly fixing the muffler to a vehicle body, extending the pipe 30 through an internal cavity of the muffler from the inlet to the outlet, and isolating the pipe 30 from direct connection to the muffler such that the pipe is freely moveable relative to the muffler.

By using the bellows connection at both ends of the muffler housing, the thru-pipe is decoupled, i.e. isolated, from experiencing muffler vibrations. Further, the bellows configuration easily accommodates the significant amount of thermal expansion within the exhaust system, which can be as great as 30 millimeters for a fixed system.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A vehicle exhaust system comprising:

an exhaust component having an inlet and an outlet, the exhaust component configured to be fixed to a vehicle body; and a pipe extending through the exhaust component from the inlet to the outlet, wherein the pipe is mounted for movement relative to the exhaust component at the inlet and the outlet.

2. The vehicle exhaust system according to claim 1 wherein the pipe comprises a single-piece pipe that extends through an internal cavity of the exhaust component and has a first pipe end located upstream of the inlet and a second pipe end located downstream of the outlet.

3. The vehicle exhaust system according to claim 2 including a first movable connector that connects the pipe to the inlet and a second movable connector that connects the pipe to the outlet.

4. The vehicle exhaust system according to claim 3 wherein the first and second movable connectors comprise first and second bellows.

5. The vehicle exhaust system according to claim 3 wherein the first movable connector comprises a bellows having a first end connected to the exhaust component at the inlet and a second end connected to the pipe.

6. The vehicle exhaust system according to claim 3 wherein the second movable connector comprises a bellows having a first end connected to the exhaust component at the outlet and a second end connected to the pipe.

7. The vehicle exhaust system according to claim 1 wherein the exhaust component comprises a muffler.

8. The vehicle exhaust system according to claim 1 including at least one rigid attachment interface between the exhaust component and the vehicle body, and including a floating attachment interface between the pipe and the exhaust component.

9. The vehicle exhaust system according to claim 8 wherein the floating attachment interface comprises a first bellows connecting the pipe to an inlet end of the exhaust component and a second bellows connecting the pipe to an outlet end of the exhaust component.

10. The vehicle exhaust system according to claim 9 wherein the exhaust component has an outer shell that defines an internal cavity, and wherein the at least one rigid attachment interface comprises a first hanger portion extending into the internal cavity, the first hanger portion connecting the outer shell to the vehicle body, and including a second hanger portion positioned within the internal cavity and connected to the pipe.

11. The vehicle exhaust system according to claim 10 wherein the first and second hanger portions are connected to each other with a resilient block.

12. A muffler for a vehicle exhaust system comprising:

an outer muffler housing defining an internal cavity, the outer muffler housing having an exhaust gas inlet and an exhaust gas outlet;

a first connection interface to attach the outer muffler housing to a vehicle body;

a pipe extending through the internal cavity of the outer muffler housing from the exhaust gas inlet to the exhaust gas outlet; and a second connection interface to attach the pipe to the outer muffler housing such that the pipe is isolated from the muffler at the exhaust gas inlet and the outlet.

13. The muffler according to claim 12 wherein the first connection interface comprises a rigid connection.

14. The muffler according to claim 12 wherein the second connection interface comprises a floating connection such that the pipe is moveable relative to the muffler at the exhaust gas inlet and outlet.

15. The muffler according to claim 12 wherein the first connection interface comprises a rigid connection and wherein the second connection interface comprises a floating connection.

16. The muffler according to claim 15 wherein the second connection interface comprises at least a first bellows that connects the pipe to an inlet end of the outer muffler housing and a second bellows that connects the pipe to an outlet end of the outer muffler housing.

17. The muffler according to claim 12 wherein the pipe comprises a single-piece pipe that includes a plurality of perforations.

18. The muffler according to claim 12 wherein the first connection interface comprises at least one muffler hanger positioned within the internal cavity to fix the outer muffler housing relative to the vehicle body, and including at least one pipe hanger positioned within the internal cavity to provide support for the pipe within the muffler outer housing.

19. The muffler according to claim 18 wherein the at least one muffler hanger and the at least one pipe hanger are connected to each other with a resilient block.

20. A method of operating a vehicle exhaust component comprising the steps of:

providing an exhaust component having an inlet and an outlet;

rigidly fixing the exhaust component to a vehicle body;

extending a pipe through an internal cavity of the exhaust component from the inlet to the outlet; and isolating the pipe from direct connection to the exhaust component at the inlet and outlet such that the pipe is moveable relative to the exhaust component at the inlet and the outlet.

21. The method according to claim 20 wherein the exhaust component comprises a muffler defining an internal cavity, and including the steps of providing the pipe as a single-piece pipe that extends through the internal cavity of the muffler with a first pipe end being located upstream of the inlet and a second pipe end being located downstream of the outlet.

22. The vehicle exhaust system according to claim 7 wherein the pipe comprises a single-piece pipe that extends through an internal cavity of the muffler and has a first pipe end located upstream of the inlet and a second pipe end located downstream of the outlet.

23. The muffler according to claim 12 wherein the pipe comprises a single-piece pipe that extends through the internal cavity, the single-piece pipe having a first pipe end located upstream of the exhaust gas inlet and a second pipe end located downstream of the exhaust gas outlet.

* * * * *